US011697860B2

(12) United States Patent
Beaudin et al.

(10) Patent No.: US 11,697,860 B2
(45) Date of Patent: Jul. 11, 2023

(54) APPARATUS AND METHOD FOR SCREENING AND DELIVERING GREEN ORE PELLETS ONTO A TRAVELLING GRATE

(71) Applicant: MÉTAL 7 INC., Sept-Îles (CA)

(72) Inventors: Steve Beaudin, Sept-Îles (CA); François Cloutier-Poirier, Sept-Îles (CA); Éric Dorval, Sept-Îles (CA)

(73) Assignee: MÉTAL 7 INC., Sept-íles (CA)

( * ) Notice: Subject to any disclaimer, the term of this patent is extended or adjusted under 35 U.S.C. 154(b) by 650 days.

(21) Appl. No.: 16/478,749

(22) PCT Filed: Jan. 17, 2018

(86) PCT No.: PCT/CA2018/050049
§ 371 (c)(1),
(2) Date: Jul. 17, 2019

(87) PCT Pub. No.: WO2018/132906
PCT Pub. Date: Jul. 26, 2018

(65) Prior Publication Data

US 2019/0360068 A1 Nov. 28, 2019

Related U.S. Application Data

(60) Provisional application No. 62/448,055, filed on Jan. 19, 2017.

(51) Int. Cl.
*C22B 1/20* (2006.01)
*F27B 9/38* (2006.01)
*F27B 21/02* (2006.01)

(52) U.S. Cl.
CPC ..... *C22B 1/20* (2013.01); *F27B 9/38* (2013.01); *F27B 21/02* (2013.01); *F27B 2009/382* (2013.01)

(58) Field of Classification Search
None
See application file for complete search history.

(56) References Cited

U.S. PATENT DOCUMENTS 3,438,491 A * 4/1969 Molinaro ..... B07B 1/14 209/931
3,539,336 A * 11/1970 Urich ..... C22B 1/2413 266/178

(Continued)

FOREIGN PATENT DOCUMENTS

CN 203245115 U 10/2013
CN 203782201 U 8/2014

(Continued)

OTHER PUBLICATIONS

Trebukov et al., "Tests of a three-product roller-type screen-layer for raw pellets." Metallurgist 32.9, pp. 284-285, 1988.

(Continued)

*Primary Examiner* — Scott R Kastler
(74) *Attorney, Agent, or Firm* — Meunier Carlin & Curfman LLC

(57) ABSTRACT

A screening apparatus comprises superposed screening decks with an upper one of the screening decks having a pellet input, and each screening deck ends with an oversize pellet output, the screening decks have screens to screen the green ore pellets from top to bottom, the oversize pellet outputs feeding the travelling grate through pellet chutes with the oversize green ore pellets of one of the upper and the lower one of the screening decks being superposed to oversize green ore pellets of the other one of the lower and the upper one of the screening decks, the pellet chutes defining a curved delivery path with an input slope at the chute pellet input greater than an output slope of the chute pellet output to reduce a delivery speed of the green ore pellets from the oversize pellet output to the travelling grate.

(Continued)

There is also provided a method for screening and delivering green ore pellets onto a travelling grate of an induration furnace.

19 Claims, 7 Drawing Sheets

(56) References Cited

U.S. PATENT DOCUMENTS

| | | | | |
|---|---|---|---|---|
| 3,864,119 | A | 2/1975 | Whitaker et al. | |
| 5,102,586 | A * | 4/1992 | Fuji | C22B 1/2406 264/117 |
| 2019/0360068 | A1* | 11/2019 | Beaudin | F27B 9/38 |

FOREIGN PATENT DOCUMENTS

| | | | |
|---|---|---|---|
| CN | 104388621 | A | 3/2015 |
| EP | 2857781 | A1 | 4/2015 |
| FR | 2663019 | A1 | 12/1991 |

OTHER PUBLICATIONS

International Search Report and Written Opinion. Issued by the International Searching Authority (CA) in Application No. PCT/CA2018/050049 dated Apr. 13, 2018. 10 pages.
Examination Report in connection to Indian patent application No. 201937031884, dated Dec. 31, 2021.

* cited by examiner

APPARATUS AND METHOD FOR SCREENING AND DELIVERING GREEN ORE PELLETS ONTO A TRAVELLING GRATE

CROSS-REFERENCE TO RELATED APPLICATIONS

This application is a national stage application filed under 35 U.S.C. 0 371 of PCT/CA2018/050049 filed Jan. 17,2018, which claims priority of U.S. provisional patent application 62/448,055 filed on Jan. 19, 2017, the specification of which is hereby incorporated by reference.

TECHNICAL FIELD OF THE INVENTION

The technical field generally relates to the screening process for green ore pellet production and to a method to deliver green ore pellets onto a travelling grate of an induration furnace. More particularly, it relates to a screening and delivering apparatus to deliver green pellets of the optimum size range for an induration process.

BACKGROUND

An important proportion of iron oxides for ironmaking are provided in a pellet shape. In reference to FIG. 1, to manufacture the pellets, an iron ore concentrate is agglomerated using one or several balling devices 20 and the green pellets are fired in an induration furnace 22, such as a moving grate furnace, grate kiln or shaft furnace, to induce diffusion bonding, thereby increasing their mechanical properties for their handling and transportation to an iron and steel making plant. Agglomerated balls (or green ore pellets) feeding an induration furnace are referred to as green pellets which are converted into fired pellets during the induration process in the induration furnace. In the induration furnace, the agglomerated balls (also referred to as green ore pellets) are sequentially dried, pre-heated, indured, and cooled.

A screening and delivering apparatus 2 is provided downstream of one or several balling devices 20 and upstream of the induration furnace 22. The balling device 20 provides green ore pellets to the screening apparatus 2. The green ore pellets are screened by one or more screenings deck(s) 30. Undersize green ore pellets may be returned to the balling device 20. The green ore pellets are delivered to the travelling grate of the induration furnace 22. Finally, fired pellets are obtained after the induration process in the furnace 22.

Often, while being delivered to the travelling grate of the induration furnace 22 from the screening deck(s) 30, the green ore pellets, which complied with the size requirements, deagglomerate and smaller size green ore pellets are delivered onto the travelling grate. There is thus a need to smoothen the agglomerated ball travelling path between the screening deck(s) and the travelling grate to reduce agglomerated ball deagglomeration.

In pelletizing plants, the induration furnace often operates at maximum capacity and is highly energy consuming. When deagglomerated balls, or undersize pellets, are laid onto the travelling grate, they tend to drop between agglomerated (larger) balls. This results in a randomly packed and dense pellet bed which requires a high energy input to fire. When the pellets are randomly laid onto the travelling grate, the heat exchange between the heat source and the pellets and between the pellets within the bed is not optimal due to the bed compaction.

Heated air is typically supplied from the top towards the bottom of the pellet bed. When descending hot air contacts a heterogeneous green ore pellet bed, large pellets and small pellets are exposed to the heated air at the same time. However, large pellets require a larger energy supply than small pellets to result in fired pellets of suitable quality. This is highly energy consuming since the maximum heat content is first transferred to both large and small pellets and the heat content must be sufficient to get through the bed and fire the large pellets that are located at the bottom of the pellet bed. There is also a need for distributing more optimally the energy to be supplied to the pellets for the firing process based on their physical properties.

In view of the above, there is a need for a screening and delivering apparatus which would be able to overcome or at least minimize some of the above-discussed prior art concerns.

BRIEF SUMMARY OF THE INVENTION

It is therefore an aim of the present invention to address the above-mentioned issues.

According to a general aspect, there is provided a screening apparatus for screening and delivering green ore pellets onto a travelling grate of an induration furnace. The screening apparatus comprises: a delivery screening deck having an oversize pellet output; and a pellet chute defining a curved delivery path having a chute pellet input to receive green ore pellets from the oversize pellet output and a chute pellet output to deliver the green ore pellets onto the travelling grate; the pellet chute defining a curve along a pellet flow direction with an input slope defined at the chute pellet input of the curved delivery path that is greater than an output slope of the chute pellet output of the curved delivery path to reduce a delivery speed of the green ore pellets from the oversize pellet output to the travelling grate.

In an embodiment, the travelling grate defines a travelling plane and the input slope of the chute pellet input ranges from −60 degrees to −90 degrees with respect to the travelling plane and the output slope of the chute pellet output ranges from 0 degree to −20 degrees with respect to the travelling plane.

In an embodiment, the output slope of the chute pellet output is between 40 and 90 degrees less inclined than the input slope of the chute pellet input.

In an embodiment, the pellet chute comprises a plurality of adjacent rolls extending transversally with respect to the curved delivery path to deliver the green ore pellets along the curved delivery path.

In an embodiment, the delivery path of the pellet chute has a curved shape that is defined by a continuous flat surface having a curved profile.

According to another general aspect, there is provided a method for screening and delivering green ore pellets onto a travelling grate of an induration furnace. The method comprises: screening green ore pellets with a delivery screening deck having an oversize pellet output, receiving green ore pellets from the oversize pellet output at a chute pellet input of a pellet chute, the pellet chute defining a curved delivery path, and delivering green ore pellets onto the travelling grate through the chute pellet output of the pellet chute, the pellet chute defining a curve along a pellet flow direction with an input slope defined at the chute pellet input of the curved delivery path that is greater than an output slope of the chute pellet output of the curved delivery path to reduce a delivery speed of the green ore pellets from the oversize pellet output to the travelling grate.

In an embodiment, the output slope of the chute pellet output is between 40 and 90 degrees less inclined than the input slope of the chute pellet input.

In an embodiment, the pellet chute comprises a plurality of adjacent rolls extending transversally with respect to the curved delivery path to deliver the green ore pellets along the curved delivery path.

In an embodiment, the delivery path of the pellet chute has a curved shape that is defined by a continuous flat surface having a curved profile.

According to still another general aspect, there is provided a screening apparatus for screening and delivering green ore pellets onto a travelling grate of an induration furnace. The screening apparatus comprises at least three screening decks including an upper screening deck, at least one middle screening deck and a lower screening deck, the upper screening deck having a pellet input, and each one of the at least three screening decks ending with an oversize pellet output, the at least three screening decks having screens being configured to screen the green ore pellets from top to bottom, the screening decks being mounted one on the top of the other, the oversize pellet outputs of the lower and middle screening decks feeding the travelling grate in superposed layers with the oversize green pellets of one of the middle screening deck and the lower screening deck being superposed to the oversize green pellets of the other one of the middle screening deck and the lower screening deck.

In an embodiment, the oversize green pellets of the middle screening deck are superposed to the oversize green pellets of the lower screening deck.

In an embodiment, the at least three screening decks extend substantially parallel to one another.

In an embodiment, the at least three screening decks are inclined at an angle ranging from 0 degree to −40 degrees with respect to a travelling plane defined by the travelling grate.

In an embodiment, the screening apparatus comprises n screening decks and n−2 middle screening decks.

In an embodiment, the screens of the at least three screening decks extend longitudinally towards the travelling grate in a delivery direction and comprise a plurality of spaced-apart rolls extending transversally with respect to the delivery direction.

In an embodiment, the screens of the at least three screening decks comprise a mesh surface. For instance, the screens of the at least three screening decks can comprise screening openings having opening sizes that are substantially uniform along the delivery direction. The screening openings can have opening sizes that vary between 10 mm and 20 mm along the delivery direction. The opening sizes of the screening openings can be larger at the upper screening deck than at the lower screening deck. The screen of the lower screening deck can comprise a larger number of screening openings than the screen of the upper screening deck.

In an embodiment, the upper screening deck is substantially shorter in length along a delivery direction than the at least one middle screening deck and the lower screening deck.

In an embodiment, the screening apparatus can further comprise pellet chutes at corresponding oversize pellet outputs of the at least one middle screening deck and of the lower screening deck, the pellet chutes having a chute pellet input and a chute pellet output between the oversize pellet outputs and the travelling grate, the pellet chutes defining a delivery path with an input slope defined at the chute pellet input of the delivery path that is greater than an output slope of the chute pellet output of the delivery path to reduce a delivery speed of the green ore pellets from the oversize pellet output to the travelling grate. The travelling grate can define a travelling plane and the input slope of the chute pellet input ranges from −60 degrees to −90 degrees with respect to the travelling plane and the output slope of the chute pellet output ranges from 0 degree to −20 degrees with respect to the travelling plane.

In an embodiment, the output slope of the chute pellet output is between 40 and 90 degrees less inclined than the input slope of the chute pellet input.

In an embodiment, the delivery path of the pellet chutes has a curved shape that is defined by a plurality of adjacent cylindrical rolls extending transversally with respect to the delivery path to deliver the green ore pellets along the delivery path.

In an embodiment, the screening apparatus further comprises a coarse pellet conveyor at the oversize pellet output of the upper screening deck.

In an embodiment, the screening apparatus further comprises a fine pellet conveyor extending substantially parallel to the travelling plane defined by the travelling grate below the lower screening deck to receive screened pellets therefrom.

According to a further general aspect, there is provided a screening apparatus for screening and delivering green ore pellets onto a travelling grate of an induration furnace. The screening apparatus comprises at least two superposed screening decks with an upper one of the at least two superposed screening decks having a pellet input, and each one of the at least two superposed screening decks ending with an oversize pellet output feeding the travelling grate, the at least two superposed screening decks having screens being configured to screen the green ore pellets from top to bottom, the oversize pellet outputs of the at least two superposed screening decks feeding the travelling grate with oversize green ore pellets of one of the upper one and a lower one of the at least two superposed screening decks being superposed to oversize green pellets of the other one of the upper one and the lower one of the at least two superposed screening decks.

In an embodiment, the oversize green ore pellets of the upper one of the at least two superposed screening decks are superposed to the oversize green pellets of the lower one of the at least two superposed screening decks.

In an embodiment, the screening apparatus further comprises a top screening deck having a pellet input and being superposed to the at least two superposed screening decks and wherein the at least two superposed screening decks comprise a middle screening deck and a lower screening deck. The top screening deck, the middle screening deck and the lower screening deck can extend substantially parallel to one another. The top screening deck, the middle screening deck and the lower screening deck can be inclined at an angle ranging from 0 degree to −40 degrees with respect to a travelling plane defined by the travelling grate.

In an embodiment, the screens of the top screening deck, the middle screening deck and the lower screening deck extend longitudinally towards the travelling grate in a delivery direction and comprise a plurality of spaced-apart rolls extending transversally with respect to the delivery direction.

In an embodiment, the screens of the top screening deck, the middle screening deck and the lower screening deck comprise a mesh surface.

In an embodiment, the screens of the top screening deck, the middle screening deck and the lower screening deck comprise screening openings having opening sizes that are substantially uniform along the delivery direction.

In an embodiment, the screens of the top screening deck, the middle screening deck and the lower screening deck comprise screening openings having opening sizes that vary between 10 mm and 20 mm along the delivery direction.

In an embodiment, the opening sizes of the screening openings are larger at the top screening deck than at the lower screening deck.

The screening apparatus as claimed in one of claims 35 and 36, wherein the screen of the lower screening deck comprises a larger number of screening openings than the screen of the top screening deck.

In an embodiment, the top screening deck is substantially shorter in length along a delivery direction than the middle screening deck and the lower screening deck.

In an embodiment, the screening apparatus further comprises pellet chutes at corresponding oversize pellet outputs of the middle screening deck and the lower screening deck, the pellet chutes having a chute pellet input and a chute pellet output between the oversize pellet output and the travelling grate, the pellet chutes defining a delivery path with an input slope defined at the chute pellet input of the delivery path that is greater than an output slope of the chute pellet output of the delivery path to reduce a delivery speed of the green ore pellets from the oversize pellet output to the travelling grate. In an embodiment, the travelling grate defines a travelling plane and the input slope of the chute pellet input ranges from −60 degrees to −90 degrees with respect to the travelling plane and the output slope of the chute pellet output ranges from 0 degree to −20 degrees with respect to the travelling plane.

In an embodiment, the output slope of the chute pellet output is between 40 and 90 degrees less inclined than the input slope of the chute pellet input.

In an embodiment, the delivery path of the pellet chutes has a curved shape that is defined by a plurality of adjacent cylindrical rolls extending transversally with respect to the delivery path to deliver the green ore pellets along the delivery path.

In an embodiment, the delivery path of the pellet chutes has a curved shape that is defined by a continuous flat surface having a curved profile.

In an embodiment, the top screening deck ends with an oversize pellet output.

In an embodiment, the screening apparatus further comprises a fine pellet conveyor extending substantially parallel to the travelling plane defined by the travelling grate below the lower screening deck to receive screened pellets therefrom.

In an embodiment, the screening apparatus further comprises a feeding conveyor and a chute positioned upstream of the top screening deck, the middle screening deck and the lower screening deck, the chute extending between the feeding conveyor and the fine pellet conveyor to guide fine pellets from the feeding conveyor to the fine pellet conveyor.

According to still another general aspect, there is provided a method for screening and delivering green ore pellets onto a travelling grate of an induration furnace. The method comprises: receiving green ore pellets at a pellet input of an upper one of at least two superposed screening decks; screening green ore pellets with a screen of the upper one of the at least two superposed screening decks; feeding the travelling grate with oversize green pellets of the upper one of the at least two superposed screening decks through an oversize pellet output of the upper one of the at least two superposed screening decks; screening green ore pellets that have been screened by the upper one of the at least two superposed screening decks with a screen of a lower one of the at least two superposed screening decks; and feeding the travelling grate with oversize green pellets of the lower one of the at least two superposed screening decks through an oversize pellet output of the lower one of the at least two superposed screening decks with oversize green ore pellets of one of the upper one and the lower one of the at least two superposed screening decks being superposed onto the travelling grate to the oversize green pellets of the other one of the upper one and the lower one of the at least two superposed screening decks.

In an embodiment, the method further comprises receiving and screening green ore pellets with a screen of a top screening deck having a pellet input and being superposed to the at least two superposed screening decks and wherein the at least two superposed screening decks comprise a middle screening deck and a lower screening deck.

In an embodiment, the oversize green ore pellets of the upper one of the at least two superposed screening decks are superposed onto the travelling grate to the oversize green pellets of the lower one of the at least two superposed screening decks.

BRIEF DESCRIPTION OF THE DRAWINGS

It will be noted that throughout the appended drawings, like features are identified by like reference numerals.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, although the embodiments of the screening apparatus and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the screening apparatus, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Moreover, it will be appreciated that positional descriptions such as "upper", "lower", "above", "below", "forward", "rearward" "left", "right" and the like should, unless otherwise indicated, be taken in the context of the figures and correspond to the position and orientation of the screening apparatus and corresponding parts, with "upper" corresponding to a position closer to a feeding conveyor of the screening apparatus and "lower" corresponding to a position closer to the travelling grate. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

Figure 3:
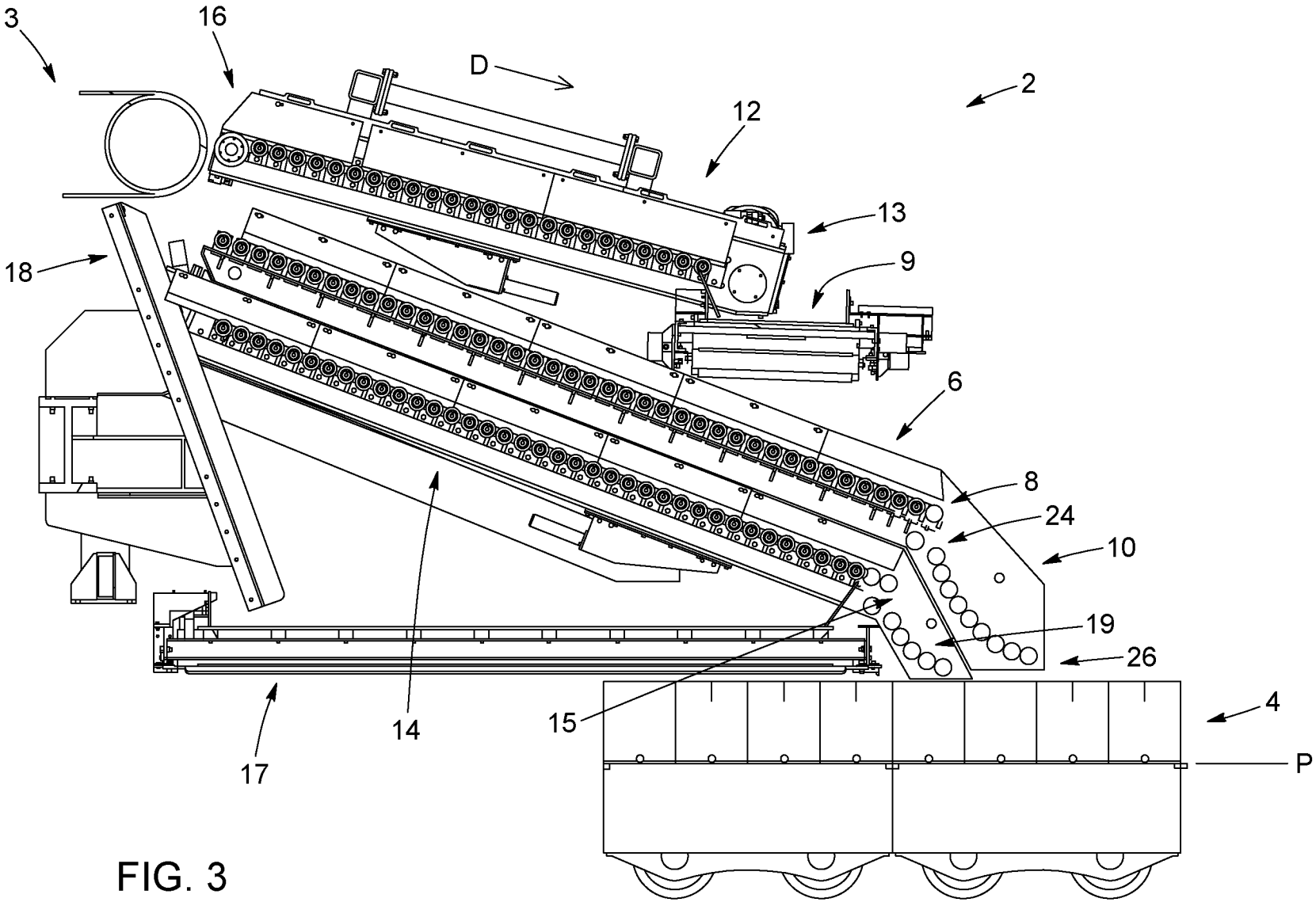
FIG. 3 is a side elevation view of a screening apparatus within its operating environment, configured to deliver green ore balls onto a travelling grate of an induration furnace, according to an embodiment.

With reference to FIG. 3, there is shown an embodiment of a screening and delivering apparatus 2 for screening and delivering green ore pellets (or agglomerated balls) onto a travelling grate 4 of an induration furnace (not shown). The screening and delivering apparatus 2 is represented within portions of its operating environment including a distal end of a feeding conveyor 3 for carrying the green ore pellets from the balling devices onto a first one 12 of the screening decks and a proximal end of the travelling grate 4, leading to the induration furnace (not shown). The screening and delivering apparatus is suitable and configured to be included into an equipment for the production of iron ore pellets.

Figure 1:
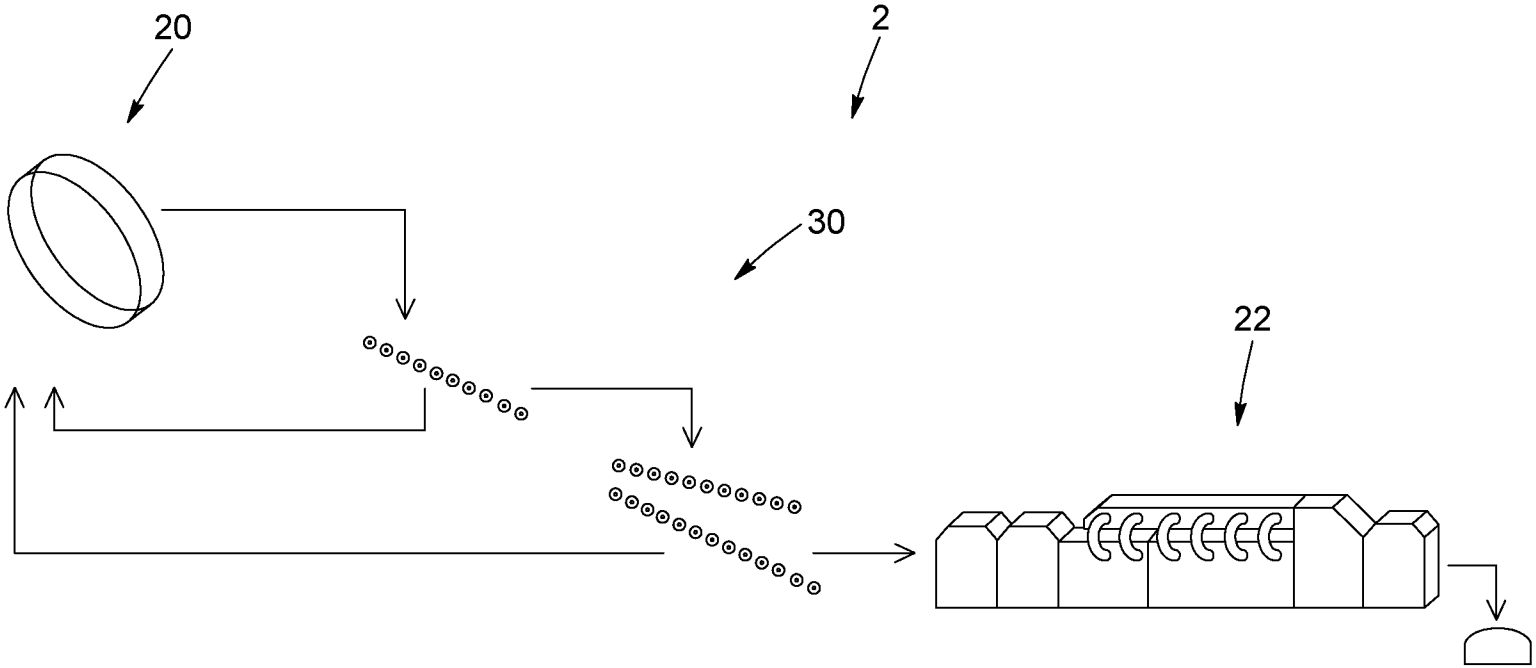
FIG. 1 (PRIOR ART)
FIG. 1 is a schematic view of equipment and steps carried for balling, screening and firing processes in the production of ore pellets in accordance with the prior art, showing the position of a screening apparatus comprising two spaced-apart sets of screening decks located between a balling device and an induration furnace.

Still referring to FIG. 3, the screening and delivering apparatus 2 is fed with green ore pellets of various sizes, previously agglomerated on the balling device(s) 20 (FIG. 1). One screening and delivering apparatus 2 can be supplied by one or a plurality of balling devices(s) 20. The green pellets are typically conveyed to the apparatus 2 on a suitable feeding conveyor 3.

As shown on FIG. 3, the screening and delivering apparatus 2 serves two main functions: screening green pellets with screening decks 6, 12, 14, and delivering green pellets onto the travelling grate 4. In an embodiment, the travelling grate 4 is continuously filled and moved towards the induration furnace 22.

In the embodiment shown, the screening and delivering apparatus 2 includes a plurality of screening decks 6, 12, 14 mounted one on the top of the other, i.e. vertically superposed. In the embodiment shown, the screening apparatus 2 includes three screening decks 6, 12, 14 mounted one on the top of the other. However, it is appreciated that, in alternative embodiments (not shown), the apparatus can include more or less screening decks. For instance, in the embodiment shown in FIG. 3, the screening and delivering apparatus 2 includes an upper screening deck 12, a middle screening deck 6, and a lower screening deck 14. In another embodiment (not shown), the screening apparatus can comprise solely an upper screening deck superposed to a lower screening deck. In an embodiment where the apparatus includes more than three screening decks, the apparatus includes two or more middle screening decks. In other words, the screening apparatus comprises n screening decks and n−2 middle screening decks.

Figure 4:
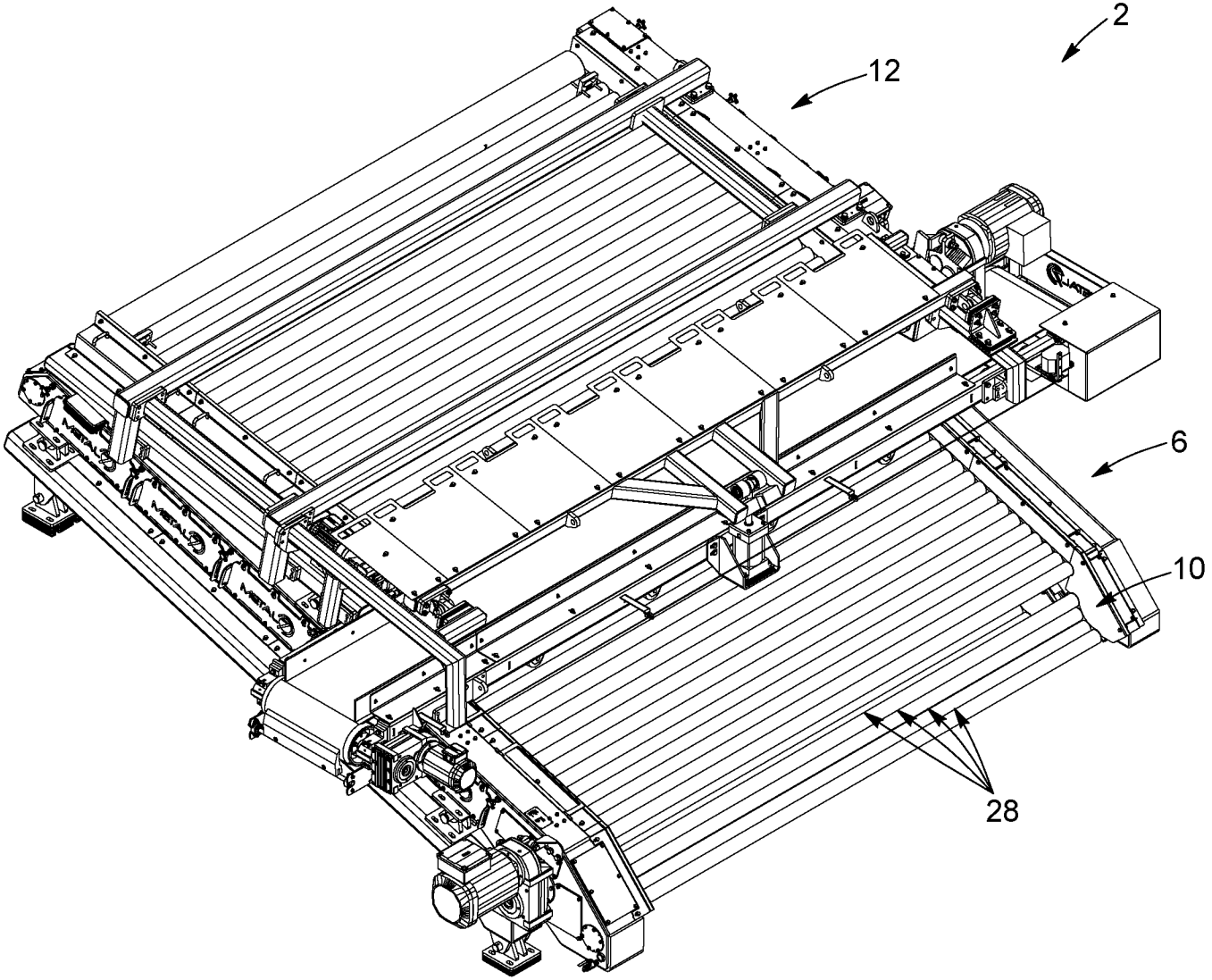
FIG. 4 is a perspective view of the screening apparatus according to an embodiment.
Figure 5:
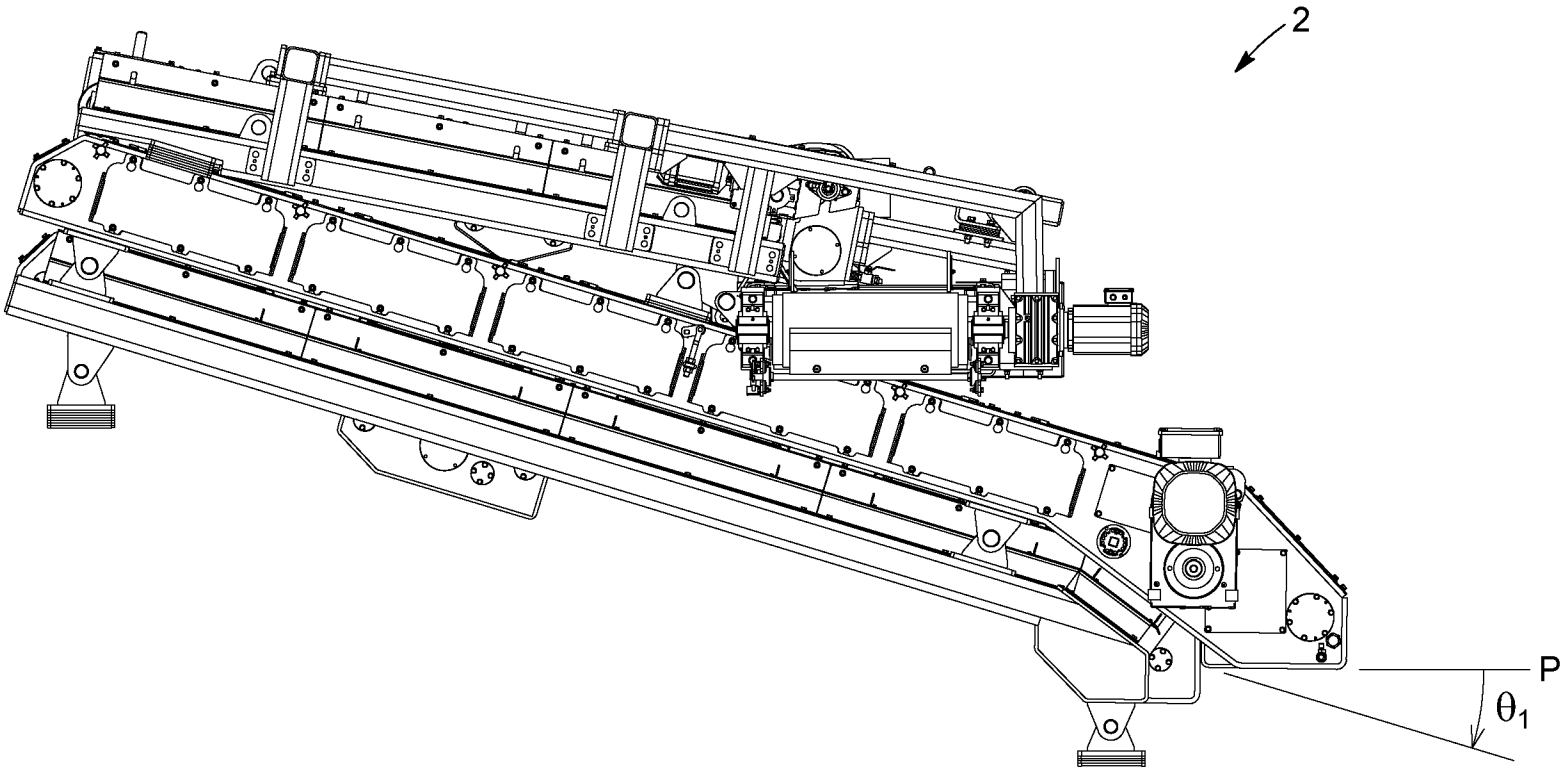
FIG. 5 is a side elevation view of the screening apparatus of FIG. 4.

In the embodiments shown on FIGS. 3 to 5, the three screening decks 6, 12, 14 are substantially parallel to one another and are inclined downwardly with respect to the travelling plane P defined by the travelling grate 4. For instance, the screening decks may be inclined at an angle θ1 ranging from 0 degree to −40 degrees with respect to the travelling plane P and, in a particular embodiment, from 5 degrees to −25 degrees. In the non-limitative embodiment shown, the upper screening deck 12 is substantially shorter in length along a delivery direction D than the middle screening deck 6 and the lower screening deck 14. In the non-limitative embodiment shown, the upper screening deck 12 is also substantially less inclined downwardly along the delivery direction D than the middle screening deck 6 and the lower screening deck 14, which extend substantially parallel to one another. It can be appreciated that the screening decks may have the same length or the same downward inclination. Each one of the screening decks 6, 12, 14 is provided with a screen that extends longitudinally towards the travelling grate 4 in the delivery direction D. As shown on FIG. 4, in the non-limitative embodiment shown, the screens comprise a plurality of spaced-apart rolls 28 extending transversally with respect to the delivery direction D.

The screens of the screening decks 6, 12, 14 are provided with screening openings having predetermined opening sizes and ends with a respective oversize pellet output 8, 13, 15. In a non-limitative embodiment, the opening size of the screening openings is uniform along the delivery direction D. For instance and without being limitative, for a screen defined by a plurality of spaced-apart rolls, the spacing between two consecutive rolls can be about 16 mm along the delivery direction D. In another embodiment, the opening size of the screening openings is variable along the delivery direction D. For instance and without being limitative, the spacing between upstream consecutive rolls can be wider (for instance, about 17 mm) than the inter-roll spacing between downstream consecutive rolls (for instance, about 16 mm). It can be appreciated that the screening openings sizes may vary between about 5 mm and about 25 mm along the delivery direction D and, in a particular embodiment, between about 5 mm and 20 mm along the delivery direction D.

The screens are capable of screening the green pellets from top to bottom. The green pellets having a diameter smaller than the predetermined openings of the screen on which they are conveyed flow through the screen and are collected either by the screening deck extending immediately below or by a fine pellet conveyor 17, as will be described in more details below. The green pellets having a diameter larger than the predetermined openings of the screen are conveyed to the respective one of the oversize pellet output to be collected either by a conveyor 9 or conveyed towards the travelling grate 4, as will be described in more details below. Thus, the screening opening sizes of the screens is decreasing from the upper screening deck 12 to the lower screening deck 14. In an embodiment wherein the screening deck is defined by a plurality of spaced-apart rolls, the screening area of the screens is calculated by multiplying the opening size value, the width of the screening deck and the quantity of openings. Considering that the screen of the lower screening deck comprises a larger number of screening openings than the screen of the upper screening deck, the screening area of the screens is therefore increasing from the upper screening deck 12 to the lower screening deck 14.

The upper deck 12 has a green pellet input 16 to receive green pellets produced by the balling device(s) and conveyed, for instance, by the feeding conveyor 3. The oversize green pellets travelling onto the upper screening deck 12 are outputted at the oversize pellet output 13 and, then, collected by a coarse, or oversize, pellet conveyor 9. In an embodiment, the oversize green pellets are conveyed, by the coarse pellet conveyor 9, to a comminution apparatus (not shown) to be deagglomerated and the deagglomerated iron ore is then returned to the balling device(s) to be agglomerated into new green pellets. The green pellets having a diameter smaller than the predetermined openings of the upper screening deck 12 flow through the upper deck 12 and are collected by the middle screening deck 6 extending immediately below the upper screening deck 12.

In an alternative embodiment, the apparatus 2 can be free of coarse pellet conveyor 9 and, for instance, the oversize green pellets of the upper deck 12 can be conveyed onto the travelling grate 4. In an embodiment, they can be superposed to the oversize green pellets of the middle and lower screening decks 6, 14.

Then, the oversize green pellets travelling onto the middle screening deck 6 are outputted at the oversize pellet output 8 and, then, transferred to the travelling grate 4, as will be described in more details below. The green pellets having a diameter smaller than the predetermined openings of the middle screening deck 6 flow through the middle screening deck 6 and are collected by the lower screening deck 14 (or another middle screening deck) extending immediately below the middle screening deck 6.

It is appreciated that if the screening apparatus 2 includes more than one middle screening deck 6, the undersize green pellets are collected by a lower one of the middle screening decks, extending immediately below, until the screening deck extending immediately below is the lower screening deck.

The oversize green pellets travelling onto the lower screening deck 14 are outputted at the oversize pellet output 15 and, then, transferred to the travelling grate 4, as will be described in more details below. The green pellets having a diameter smaller than the predetermined openings of the lower screening deck 14 flow through the lower screening deck 14 and are collected by a fine pellet conveyor 17 extending immediately below the lower screening deck 14. As shown, in a non-limitative embodiment, the fine pellet conveyor 17 extends substantially parallel to the travelling plane P defined by the travelling grate 4. In an embodiment, the green pellets collected by the fine pellet conveyor 17 are returned to the balling device(s) to be further agglomerated.

In the non-limitative embodiment shown, the screening apparatus 2 can include a chute 18 positioned upstream of the screening decks 6, 12, 14. The chute 18 extends between the feeding conveyor 3 and the fine pellet conveyor 17 and is used to guide fine green pellets and direct same onto the fine pellet conveyor 17 to be returned to the balling device(s) to be further agglomerated.

In the embodiment shown on FIG. 3, the apparatus 2 comprises two delivery screening decks 6, 14, i.e. screening decks having their oversize green pellets conveyed to the travelling grate 4. In the embodiment shown, the middle screening deck 6 and the lower screening deck 14 are delivery screening decks. It is appreciated that, in alternative embodiments, the apparatus 2 can include only one delivery screening deck or more than two delivery screening decks. For instance, in an embodiment (not shown), the oversize pellets of the upper screening deck 12 can also be delivered onto the travelling grate 4.

As mentioned above, in the non-limitative embodiment shown, the oversize pellet output 8, 15 of the delivery screening decks 6, 14 is configured to deliver green pellets to the travelling grate 4. Therefore, in the embodiment shown, the screening and delivering apparatus 2 comprises two pellet chutes 10, 19 (one for each oversize pellet output 8, 15) that extend between the respective one of the oversize pellet outputs 8, 15 and the travelling grate 4. In the non-limitative embodiment shown, each one of the pellet chute 10, 19 defines a curved delivery path for the green pellets.

The pellet chute 10 has a chute pellet input 24 and a chute pellet output 26 between the oversize pellet output 8 and the travelling grate 4. The chute pellet input 24 receives green ore pellets from the oversize pellet output 8 of the delivery screening deck 6. The chute pellet output 26 delivers the green ore pellets onto the travelling grate 4. The pellet chute 10 defines a curve along a pellet flow direction with a slope that is greater at the input of the curved delivery path than at the output of the curved delivery path. This slope configuration reduces the delivery speed of the green pellets before they reach the travelling grate 4, or in other words, it reduces the delivery speed of the pellets from the oversize pellet output to the travelling grate. Thereby, the deagglomeration of the green ore pellets between the screening decks 6, 14 and the traveling grate 4 is reduced, as will be described in more details below.

Figure 6:
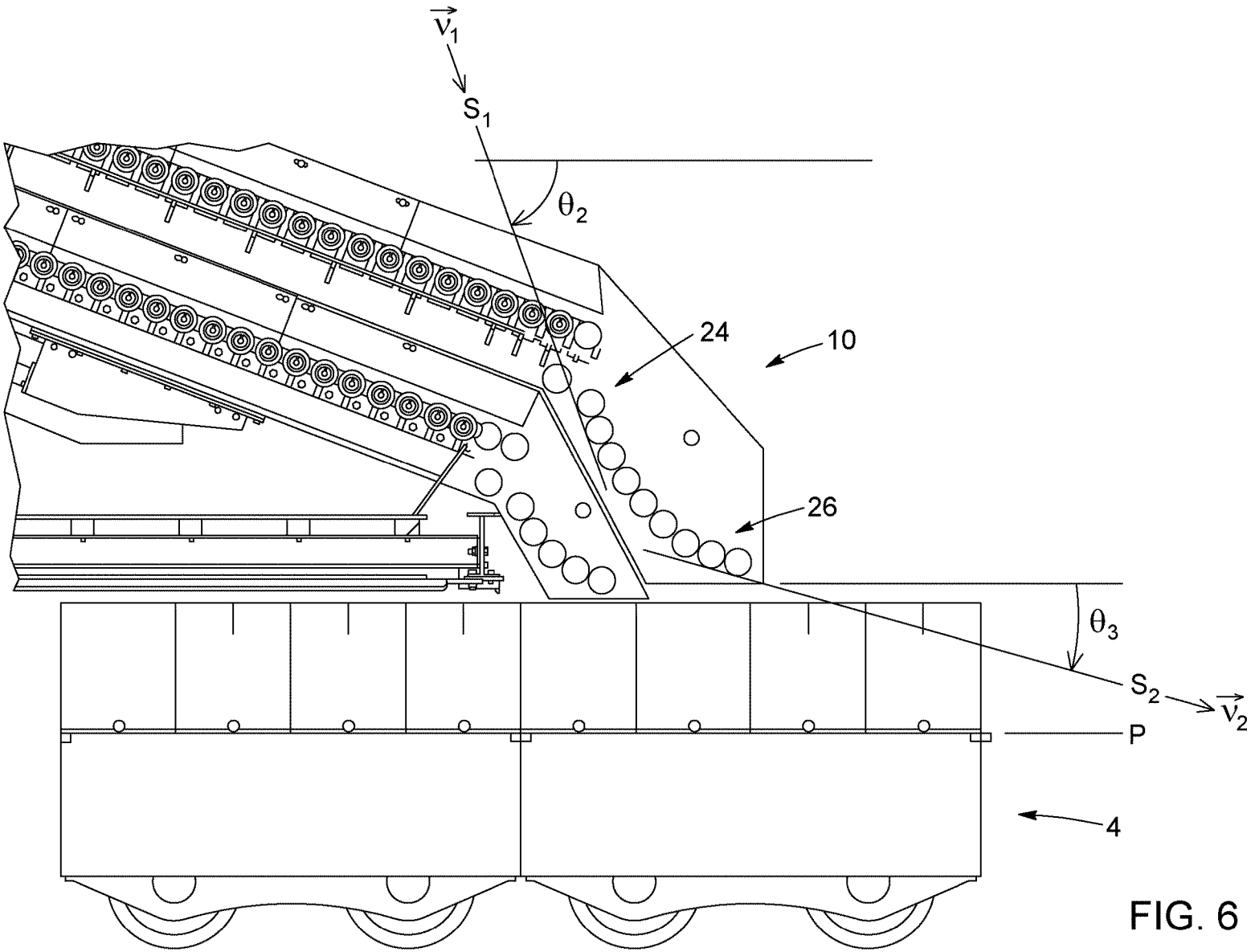
FIG. 6 is an enlarged view of an output section of the screening apparatus of FIG. 3 showing input and output slope angles of a chute pellet input and output respectively.

Referring now to FIG. 6, there is shown an enlarged view of the screening and delivering apparatus 2 of FIG. 3 showing the configuration of the input slope and the output slope of the pellet chute 10. As shown, the travelling grate 4 defines a travelling plane P that extends substantially horizontally in the embodiment shown. However, it can be appreciated that the travelling plane P can be inclined. The input slope and the output slope are defined by lines S1 and S2 extending tangentially to the curved delivery path respectively at the chute pellet input 24 and at the chute pellet output 26 and are measured with respect to the travelling plane P. As shown, the input slope, referred to as θ2, of the chute pellet input 24 ranges from about −60 degrees to −90 degrees with respect to the travelling plane P (i.e. in a downward orientation with respect to the travelling plane P and the delivery direction D). More precisely, in this implementation where the pellet chute 10 is defined by a plurality of cylindrical rolls, S1 and S2 extend tangentially to about the first two rolls at the chute pellet input 24 and to about the last two rolls at the chute pellet output 26. The output slope, referred to as θ3, of the chute pellet output 26 ranges from about 0 degree to −20 degrees with respect to the travelling plane P. The angles θ2 and θ3 thus define the orientation of the pellet speed vectors v1 and v2. In a non-limitative embodiment, the output slope θ3 of the chute pellet output 26 is between about 40 and 90 degrees less inclined than the input slope of the chute pellet input 24.

The lower screening deck 14 is provided with an oversize pellet output 15 and a pellet chute 19 that has a similar configuration of input and output slopes than the pellet chute 10 of the middle screening deck 6. The pellet chute 19 similarly defines a curve along a pellet flow direction with a slope that is greater at the input of the curved delivery path than at the output of the curved delivery path. By reducing the delivery speed of the green pellets before they reach the travelling grate 4, the partial or entire deagglomeration of the green pellets is reduced when they reach the travelling grate 4. Additionally, reducing the delivery speed decreases the density of the pellet bed on the travelling grate and green pellet disintegration during transfer between the oversize pellet output 8 and the travelling grate 4. The combination of the lower pellet bed density, as will be described in more details below, and fewer green pellet fragments, resulting from green pellet disintegration, increases the pellet bed permeability to the heat air draft. A higher pellet bed permeability increases the efficiency of the induration process. Examples of pellet beds are shown on FIGS. 2 and 7, with the pellet bed of FIG. 7 being less dense than the pellet bed of FIG. 2.

Now referring to FIG. 4, the pellet chute 10 of the screening deck 6 comprises a plurality of adjacent cylindrical rolls 28 that extend transversally with respect to the curved delivery path. The pellet chute 19 of the lower screening deck similarly comprises a plurality of adjacent cylindrical rolls. However, it is appreciated that the curved shape of the pellet chutes 10, 19 can be defined by a pellet support different from the plurality of cylindrical rolls. In an embodiment (not shown), the delivery path of at least one or both pellet chutes has a curved shape that is defined by a continuous flat surface having a curved profile.

It is appreciated that the curved shape of the pellet chutes 10, 19 can be similar. Similarly, the slope of the pellet chutes 10, 19 at the input and output of the chutes 10, 19 can be similar or different.

Figure 2:
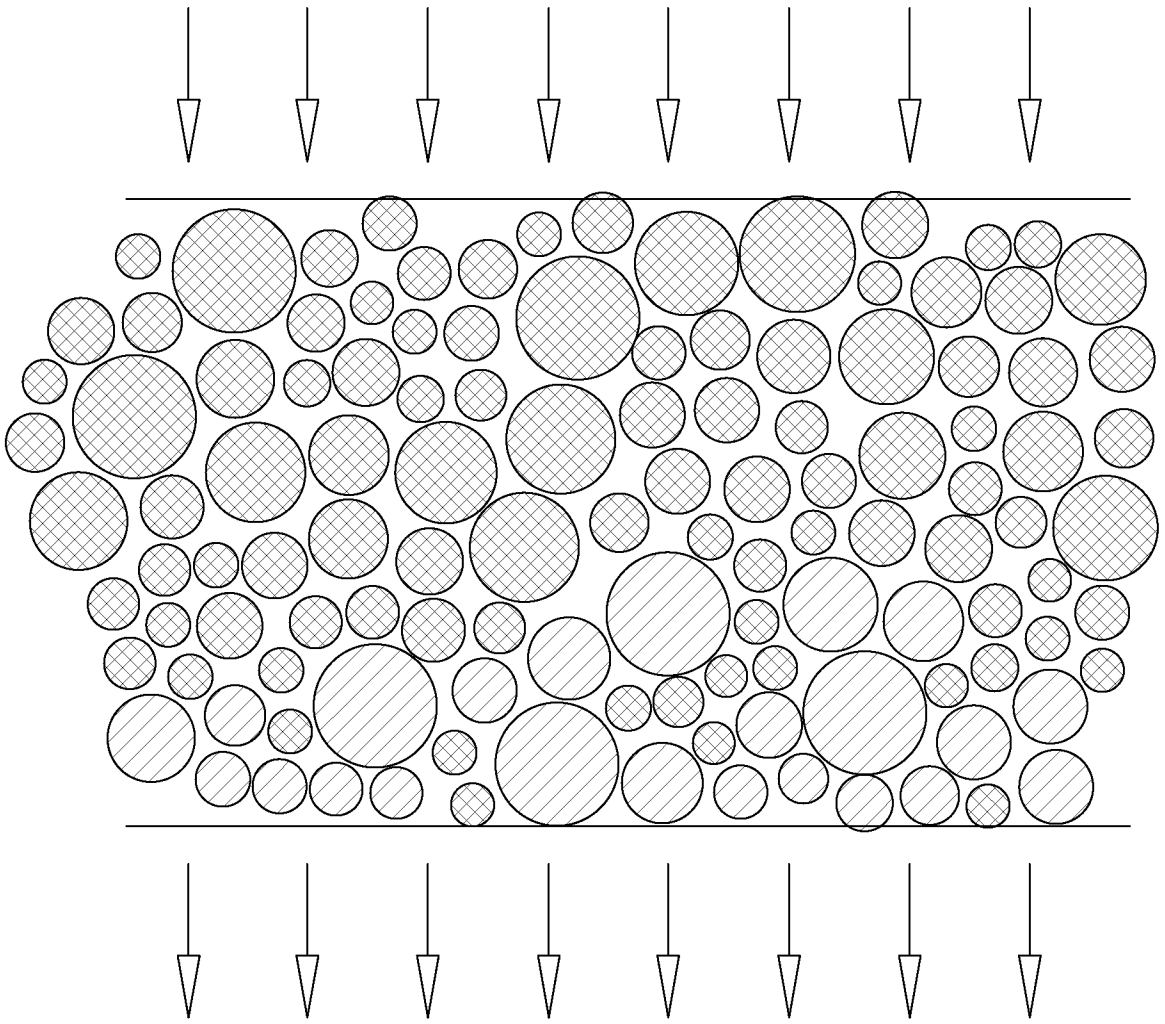
FIG. 2 (PRIOR ART)
FIG. 2 is schematic side elevation view of a green pellet bed with pellet segregation obtained with an apparatus of the prior art.
Figure 7:
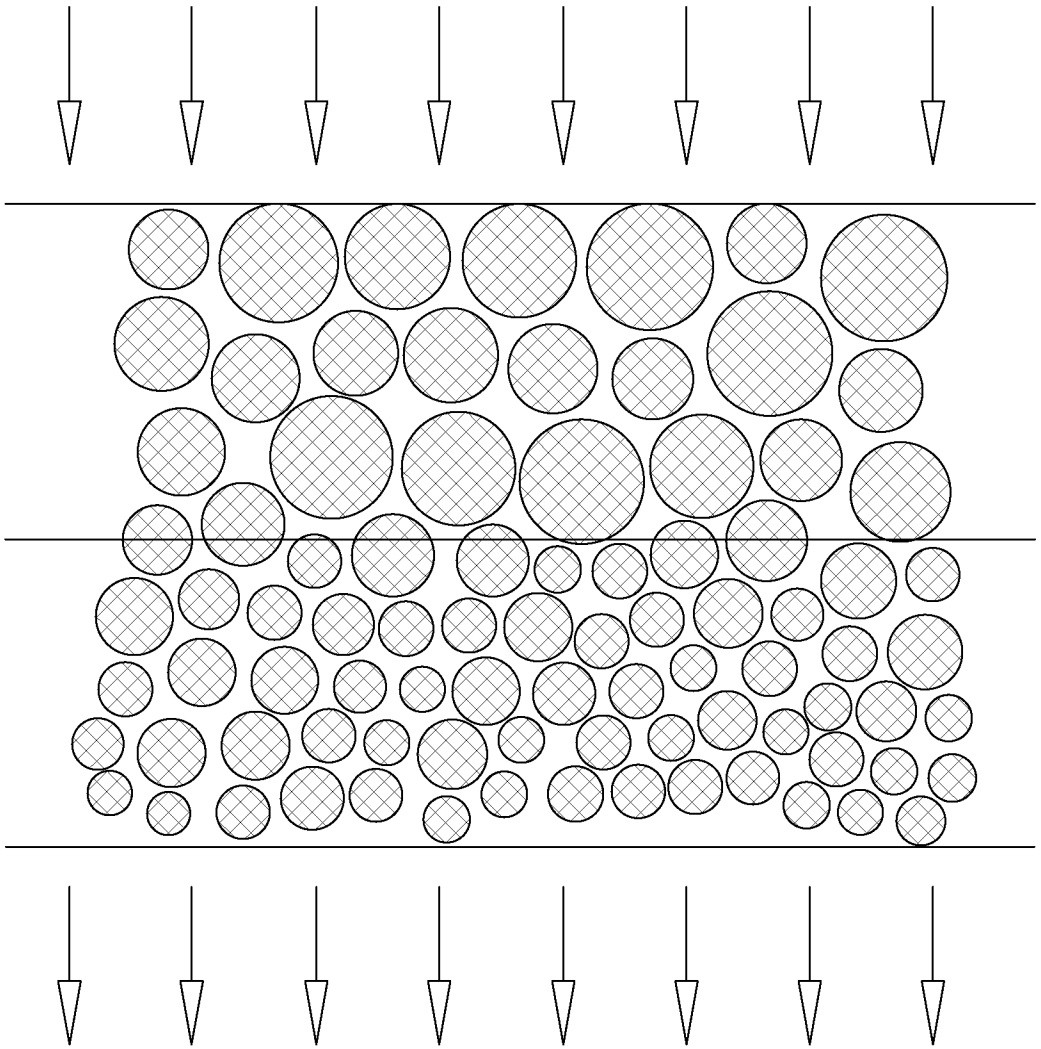
FIG. 7 is a schematic side elevation view of a green pellet bed with pellet segregation obtained with the screening apparatus.

Now referring to FIGS. 2, 3 and 7 and as detailed above, the screening and delivery apparatus 2 is provided with two pellet chutes 10, 19, each one being associated with a respective oversize pellet output 8, 15 and conveying green pellets of different sizes towards the travelling grate 4. The pellet chute 10 conveys green pellets of a larger mean diameter than the pellet chute 19.

Due to the configuration of the pellet chutes 10, 19 and the travelling grate 4 travelling towards the induration furnace (towards the right in FIG. 3), the pellet chute 19 lays down a first layer of green pellets over a layer of fired pellets which acts as a bottom layer and is referred to as a "hearth layer". Then, the pellet chute 10 lays down a second layer of green pellets, superposed to the first layer. The second layer is characterized by green pellets having a mean diameter greater than the mean diameter of the green pellets of the first layer, i.e. the green pellets of the second layer are coarser than the green pellets of the first layer, i.e. the green pellets of the second layer are characterized by a larger mean diameter than the mean diameter of the first layer green pellets. Thus, when entering the induration furnace, the green pellet bed is segregated into two superposed layers of green pellets, each one of the layers being characterized by green pellets having a different mean diameter, as shown in FIG. 7.

Since the heated air draft is typically flowing downwardly in the pre-heating and firing chambers of the induration furnace, the coarser green pellets are exposed to warmer heated air than the smaller green pellets of the first layer as shown on FIG. 7. As it can be appreciated, coarser green pellets require a higher energy supply to be converted into fired pellets of a suitable quality. Therefore, by contacting the coarser green pellets first with warmer heated air, the latter are provided with a higher energy input. The efficiency of the induration process is thereby improved given that smaller green pellets are located at the bottom of the bed and require less warm air to be heated and fired than coarser green pellets. Furthermore, segregation of the green pellet layers improves the bed permeability, which is contrary to an heterogenous green pellet bed as shown in FIG. 2, for which coarser green pellets are randomly distributed in the pellet bed.

It is appreciated that, in an alternative embodiment wherein the heated air draft in the induration furnace is flowing upwardly in the pre-heating and firing chambers, the coarser green pellets can be laid down as a first layer and the smaller green pellets can be superposed to the coarser green pellets.

It is also appreciated that, in an alternative embodiment, the green pellet bed can include more than two superposed layers of green pellets, each one of the layers being characterized by green pellets having a different mean diameter. For instance, if the three screening decks 6, 12, 14 of the screening and delivery apparatus 2 shown in FIG. 3 deliver oversize green pellets onto the travelling grate 4 in superposed layers, the travelling grate 4 will include three superposed layers of green pellets, the three layers being superposed to a layer of fired pellets and being characterized by a different pellet mean diameter. In one embodiment, the green pellets characterized by a smaller mean diameter are located closer to the fired pellet layer.

It is appreciated that, in alternative embodiments, the curved shaped pellet chute can be provided with a screening and delivery apparatus 2 having only one delivery screening deck. Furthermore, a screening and delivery apparatus having two or more delivery screening decks and configured to supply the travelling grate 4 with superposed layers of green pellets characterized by a different mean diameter can be provided without the curved shaped pellet chutes for conveying green pellets to the travelling grate.

With the above-described embodiments of screening apparatus, there is also provided a method for screening and delivering green ore pellets onto a travelling grate of an induration furnace. The method is carried out by screening green ore pellets with a delivery screening deck having an oversize pellet output, receiving green ore pellets from the oversize pellet output at a chute pellet input of a pellet chute, with the pellet chute defining a curved delivery path. Finally, the method includes delivering green ore pellets onto the travelling grate through the chute pellet output of the pellet chute. The pellet chute defines a curve along a pellet flow direction with an input slope defined at the chute pellet input of the curved delivery path that is greater than an output slope of the chute pellet output of the curved delivery path. The configuration of the input slope and the output slope reduces the delivery speed of the green ore pellets from the oversize pellet output to the travelling grate.

There is also provided another method for screening and delivering green ore pellets onto a travelling grate of an induration furnace. The screening apparatus used includes at least two superposed screening decks. The method is carried out by receiving green ore pellets at a pellet input of an upper one of at least two superposed screening decks, screening green ore pellets with a screen of the upper one of the at least two superposed screening decks and feeding the travelling grate with oversize green pellets of the upper one of the at least two superposed screening decks through an oversize pellet output of the upper one of the at least two superposed screening decks. Then, the method includes screening green ore pellets that have been screened by the upper one of the at least two superposed screening decks with a screen of a lower one of the at least two superposed screening decks, and feeding the travelling grate with oversize green pellets of the lower one of the at least two superposed screening decks through an oversize pellet output of the lower one of the at least two superposed screening decks with oversize green ore pellets of the upper one of the at least two superposed screening decks being superposed onto the travelling grate to oversize green pellets of the lower one of the at least two superposed screening decks.

It will be appreciated that the methods described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

What is claimed is:

1. A screening apparatus for screening green ore pellets and delivering oversize green ore pellets to an induration furnace via a travelling grate displacing the oversize green ore pellets along a travelling direction, the screening apparatus comprising at least one delivery screening deck extending towards the travelling grate in a delivery direction and having an oversize pellet output; and a pellet chute defining a curved delivery path having a chute pellet input to receive the oversize green ore pellets from the oversize pellet output and a chute pellet output to deliver the oversize green ore pellets onto the travelling grate;

the pellet chute defining a curve along a pellet flow direction with an input slope defined at the chute pellet input of the curved delivery path that is greater than an output slope of the chute pellet output of the curved delivery path to reduce a delivery speed of the green ore pellets from the oversize pellet output to the travelling grate, wherein the pellet chute comprises a plurality of adjacent rolls extending transversally with respect to the curved delivery path to deliver the oversize green ore pellets along the curved delivery path;

wherein the delivery direction, the pellet flow direction and the travelling direction share a common forward direction.

2. The screening apparatus as claimed in claim 1, wherein the travelling grate defines a travelling plane and the input slope of the chute pellet input ranges from −60 degrees to −90 degrees with respect to the travelling plane and the output slope of the chute pellet output ranges from 0 degree to −20 degrees with respect to the travelling plane and is between 40 and 90 degrees less inclined than the input slope of the chute pellet input.

3. The screening apparatus as claimed in claim 1, comprising at least three screening decks including an upper screening deck, at least one middle screening deck and a lower screening deck, the upper screening deck having a pellet input, and each one of the at least three screening decks ending with an oversize pellet output, the at least three screening decks having screens being configured to screen the green ore pellets from top to bottom, the screening decks being mounted one on the top of the other, the oversize pellet outputs of the lower and middle screening decks feeding the travelling grate in superposed layers with the oversize green pellets of one of the middle screening deck and the lower screening deck being superposed to the oversize green pellets of the other one of the middle screening deck and the lower screening deck.

4. The screening apparatus as claimed in claim 3, wherein the oversize green pellets of the middle screening deck are superposed to the oversize green pellets of the lower screening deck and the upper screening deck, the at least one middle screening deck and the lower screening deck comprise screening openings having opening sizes that vary between 10 mm and 20 mm along the delivery direction with the opening sizes of the screening openings being larger at the upper screening deck than at the lower screening deck.

5. The screening apparatus as claimed in claim 3, further comprising a fine pellet conveyor extending substantially parallel to a travelling plane defined by the travelling grate below the lower screening deck to receive screened pellets therefrom.

6. The screening apparatus as claimed in claim 1, the screening apparatus comprising at least two superposed screening decks with an upper one of the at least two superposed screening decks having a pellet input, and each one of the at least two superposed screening decks ending with an oversize pellet output feeding the travelling grate, the at least two superposed screening decks having screens being configured to screen the green ore pellets from top to bottom, the oversize pellet outputs of the at least two superposed screening decks feeding the travelling grate with oversize green ore pellets of one of the upper one and a lower one of the at least two superposed screening decks being superposed to oversize green pellets of the other one of the upper one and the lower one of the at least two superposed screening decks.

7. The screening apparatus as claimed in claim 6, wherein the oversize green ore pellets of the upper one of the at least two superposed screening decks are superposed to the oversize green pellets of the lower one of the at least two superposed screening decks.

8. The screening apparatus as claimed in claim 6, further comprising a top screening deck having a pellet input and being superposed to the at least two superposed screening decks and wherein the at least two superposed screening decks comprise a middle screening deck and a lower screening deck, and wherein the top screening deck, the middle screening deck and the lower screening deck are inclined at an angle ranging from 0 degree to −40 degrees with respect to a travelling plane defined by the travelling grate.

9. The screening apparatus as claimed in claim 8, wherein the screens of the top screening deck, the middle screening deck and the lower screening deck comprise a mesh surface with screening openings having opening sizes that are substantially uniform along the delivery direction and wherein the top screening deck, the middle screening deck and the lower screening deck extend substantially parallel to one another.

10. The screening apparatus as claimed in claim 8, wherein the screens of the top screening deck, the middle screening deck and the lower screening deck comprise screening openings having opening sizes that vary between 10 mm and 20 mm along a delivery direction with the opening sizes of the screening openings being larger at the top screening deck than at the lower screening deck.

11. The screening apparatus as claimed in claim 8, further comprising a fine pellet conveyor extending substantially parallel to a travelling plane defined by the travelling grate below the lower screening deck to receive screened pellets therefrom, further comprising a feeding conveyor and a chute positioned upstream of the top screening deck, the middle screening deck and the lower screening deck, the chute extending between the feeding conveyor and the fine pellet conveyor to guide fine pellets from the feeding conveyor to the fine pellet conveyor.

12. A method for screening green ore pellets and delivering oversize green ore pellets to an induration furnace, the method comprising:

screening the green ore pellets along a delivery direction with a delivery screening deck having an oversize pellet output, receiving oversize green ore pellets from the oversize pellet output at a chute pellet input of a pellet chute, the pellet chute defining a curved delivery path, delivering the oversize green ore pellets onto a travelling grate through the chute pellet output of the pellet chute, the pellet chute defining a curve along a pellet flow direction with an input slope defined at the chute pellet input of the curved delivery path that is greater than an output slope of the chute pellet output of the curved delivery path to reduce a delivery speed of the oversize green ore pellets from the oversize pellet output to the travelling grate, wherein the pellet chute comprises a plurality of adjacent rolls extending transversally with respect to the curved delivery path to deliver the oversize green ore pellets along the curved delivery path; and delivering the oversize green ore pellets to the induration furnace via the travelling grate along a travelling direction, wherein the travelling direction, the delivery direction and the pellet flow direction have horizontal directional components in a same forward direction.

13. The method as claimed in claim 12, wherein the output slope of the chute pellet output is between 40 and 90 degrees less inclined than the input slope of the chute pellet input.

14. The screening apparatus as claimed in claim 1, wherein said at least one delivery screening deck is inclined downwardly with respect to a travelling plane of the travelling grate.

15. A screening apparatus for screening green ore pellets and delivering oversize green ore pellets to an induration furnace via a travelling grate displacing the oversize green ore pellets along a travelling direction, the screening apparatus comprising at least three superposed screening decks extending towards the travelling grate in substantially parallel delivery directions, said at least three screening decks including an upper screening deck, at least one middle screening deck and a lower screening deck, wherein the upper screening deck has a pellet input, and each one of the at least three screening decks end with an oversize pellet output, wherein the at least three screening decks have screens configured to screen the green ore pellets from top to bottom, the screening decks being mounted one on the top of the other, the oversize pellet outputs of the lower and the at least one middle screening decks feeding the travelling grate in superposed layers with the oversize green pellets of one of the at least one middle screening deck and the lower screening deck being superposed to the oversize green pellets of the other one of the at least one middle screening deck and the lower screening deck; and at least two pellet chutes each defining a curved delivery path having a chute pellet input to receive respectively the oversize green ore pellets from the oversize pellet output of the at least one middle screening deck and the lower screening deck and a chute pellet output to deliver the oversize green ore pellets onto the travelling grate;

each one of the at least two pellet chutes defining a curve along a pellet flow direction, wherein the delivery directions of the at least three superposed screening decks, the pellet flow direction of the at least two pellet chutes and the travelling direction share a common forward direction.

16. The screening apparatus as claimed in claim 15, wherein the curve of each one of the at least two pellet chutes has an input slope defined at the corresponding chute pellet input of the curved delivery path that is greater than an output slope of the corresponding chute pellet output of the curved delivery path to reduce a delivery speed of the oversize green ore pellets from the oversize pellet output to the travelling grate.

17. The screening apparatus as claimed in claim 16, wherein at least one of the input slopes and the output slopes of said at least two pellet chutes are identical.

18. The screening apparatus as claimed in claim 15, wherein at least one of said at least two pellet chutes comprises a plurality of adjacent rolls extending transversally with respect to the curved delivery path to deliver the oversize green ore pellets along the curved delivery path.

19. The screening apparatus as claimed in claim 15, wherein the delivery path of at least one of said at least two pellet chutes has a curved shape that is defined by a continuous flat surface having a curved profile.

* * * * *